US006783091B2

(12) United States Patent
Whaley

(10) Patent No.: US 6,783,091 B2
(45) Date of Patent: Aug. 31, 2004

(54) TWO-FLUTED HOUSING LINER

(75) Inventor: Craig S. Whaley, Mount Carmel, IL (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 10/056,825

(22) Filed: Jan. 25, 2002

(65) Prior Publication Data

US 2003/0141396 A1 Jul. 31, 2003

(51) Int. Cl.[7] ..... B02C 15/14
(52) U.S. Cl. ..... 241/103; 241/119; 241/285.1
(58) Field of Search ..... 241/103, 291, 241/299, 104–122, 207–216, 285.1

(56) References Cited

U.S. PATENT DOCUMENTS 2,275,595 A * 3/1942 Schwartz ..... 241/103
2,378,681 A * 6/1945 Bailey et al. ..... 241/103
2,545,254 A * 3/1951 Bice ..... 241/103
5,971,306 A * 10/1999 Ganser et al. ..... 241/207

OTHER PUBLICATIONS (Author Unknown).—B&W Pulverizer Type–EL—For Pulverized–Fuel Firing Systems. Copyright 1956. The Babcock & Wilcox Company. 28 pages.

(Author Unknown).—Brochure—Pulverizer Parts Identification for B&W EL–64 Pulverizer. Copyright 2001. The Babcock & Wilcox Company. 1 page.

* cited by examiner

*Primary Examiner*—Mark Rosenbaum
(74) *Attorney, Agent, or Firm*—Eric Marich

(57) ABSTRACT

A pulverizer housing liner for the housing unit of an EL pulverizer is made up of an arcuate liner body having an inner curved surface forming a segment of the circular housing unit and two circumferentially spaced flutes fixed to the inner surface.

6 Claims, 4 Drawing Sheets

TWO-FLUTED HOUSING LINER

FIELD AND BACKGROUND OF THE INVENTION

The present invention relates generally to the field of coal pulverizers and, in particular, to a new and useful housing liner for an EL type or other pulverizer. More particularly, the present invention is drawn to a feature for the housing liner which provides for longer wear life and reduced incidences of parts failures.

Coal pulverizers are used to grind, dry and classify raw chunks of coal into fine solids which can be fluidized and fed, for example, to burners used in conjunction with industrial or utility boilers or furnaces. See, for example, U.S. Pat. Nos. 2,275,595 and 2,378,681. As is known to those skilled in the art, several different types of coal pulverizers, or coal mills, exist today, including one known by the designation "EL."

EL type pulverizers were first produced in the early 1950's. EL type pulverizers are ball-and-ring (or ball-and-race) type pulverizers which employ the ball-bearing principle to grind the coal. This design uses two vertical axis horizontal grinding rings, and a set of balls is placed between the grinding rings. The lower or bottom grinding ring rotates through connection to a rotating, vertical main shaft, while the upper or top grinding ring remains stationary and is spring loaded to create grinding pressure.

The coal is ground by contact with the upper and lower grinding rings and balls (collectively, the grinding elements). The lower and upper grinding rings are each provided with a race having a predefined, matching track contour that engages the balls. The force from the upper grinding ring pushes the balls against the coal layer on the lower grinding ring. The grinding rings and the balls are made of abrasion resistant alloys and comprise the major wear parts of the mill. Ground coal is swept from the grinding zone defined by the grinding rings and the balls by air for final particle size classification and subsequent pneumatic transport to one or more coal burners.

For further details of such EL type pulverizers, see Chapter 12 of *Steam/Its Generation and Use,* 40th Edition, Stultz and Kitto, Eds., Copyright ©1992, The Babcock & Wilcox Company, the text of which is hereby incorporated by reference as though fully set forth herein.

Existing EL pulverizers include a housing unit made up of a plurality of circumferentially extending, side-by-side, replaceable housing liners. Known housing liners have one or no flutes as illustrated in FIG. 1. Housing liner 10 has an inner curved surface 12 that faces the balls. A single flute 14 that is inclined with respect to the vertical axis of the pulverizer is fixed to the inner surface. With the one-flute or no-flute design, excessive erosion is experienced with erosive coals. Efforts to stop or reduce this erosion have not been successful to date.

FIG. 3 shows the single fluted housing liner 10 after a period of use, with an area 18 that has been completely eroded through the liner on one side of the flute 14 and the flute itself greatly eroded. This is an extremely dangerous condition since it only leaves the relatively thin housing wall as the only shield between the pulverized coal and workers in the area of the pulverizer.

SUMMARY OF THE INVENTION

It is an object of the present invention to provide a pulverizer housing liner comprising an arcuate liner body having an inner curved surface forming a segment of a circular housing unit and two circumferentially spaced flutes fixed to the inner surface.

A further object of the invention is to provide the flutes at a spacing that reduces recirculation or impact zones ahead of or behind adjacent flutes in the particular liner in question, and in upstream or downstream lines around the housing unit.

The advantages of the invention are thus in the prevention of coal recirculation or impact zones ahead or behind adjacent flutes. The added flute material also acts as a sacrificial wear surface. For equivalent wear periods with the same coal, erosion of the liner is significantly reduced as illustrated by comparing FIGS. 3 and 4. The exterior of the housing is thus better protected against premature wear through. Premature wear through of the exterior housing is a hazard to life and property as large quantities of combustible coal could be released from the pulverizer due to premature housing liner wear.

Accordingly, another object of the invention is to provide the housing liner with a plurality of flutes, including more than two flutes in pulverizers with higher processing rates or sizes or pulverizers with circumferentially longer housing liners.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 5:
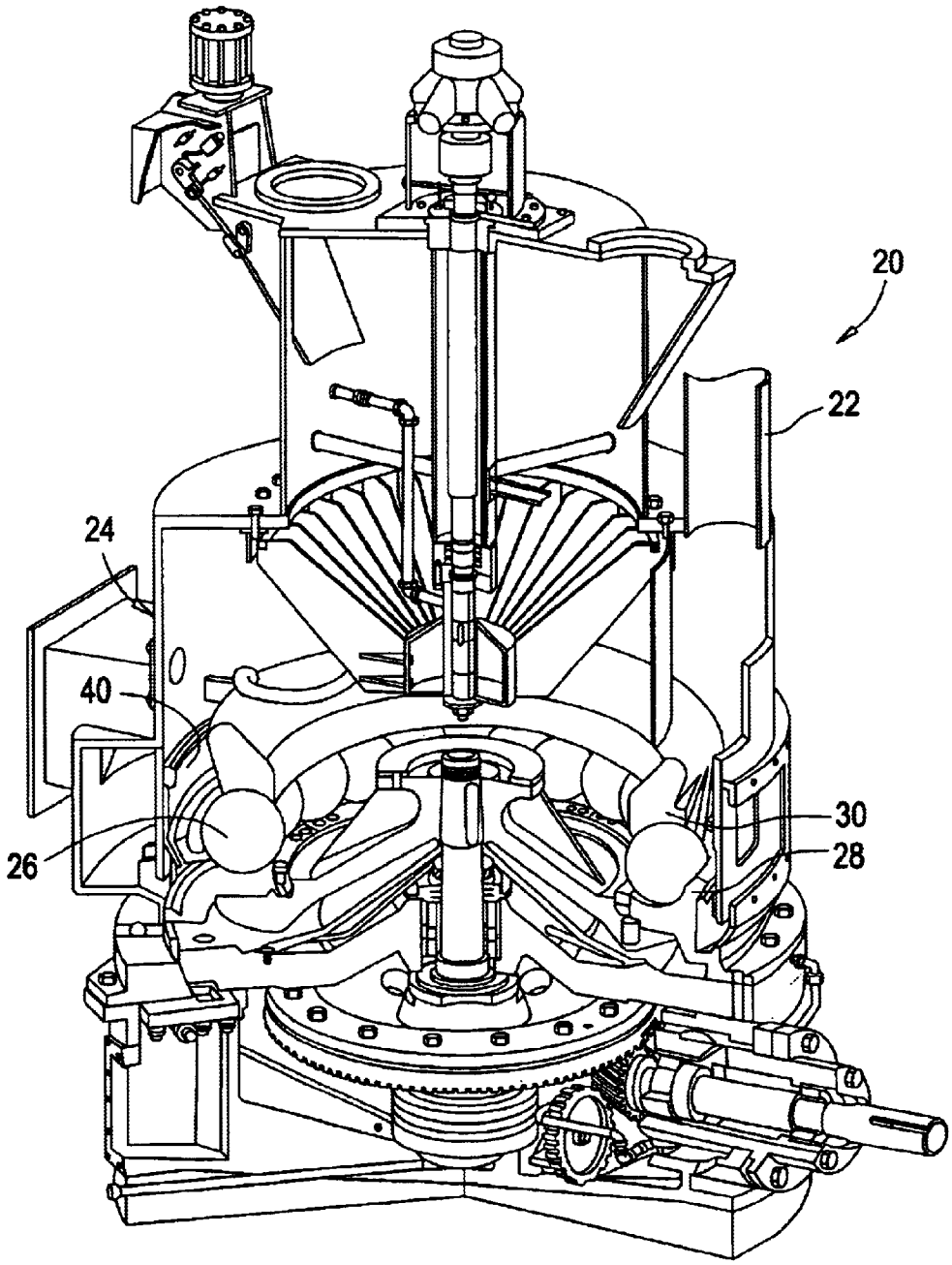
FIG. 5 is a perspective, cutaway view of an EL pulverizer using the housing liners according to the present invention.

Referring now to the drawings, in which like reference numerals are used to refer to the same or functionally similar elements, FIG. 5 is a perspective view of a type EL pulverizer generally designated 20 for grinding incoming material such as coal entering through a raw coal downspout 22.

Grinding or crushing of coal in the type EL pulverizer 20 is conducted within a pulverizer housing 24. The pulverizer housing contains a plurality of pulverizer balls 26, which rest in a track established between a bottom grinding ring 28 and a top grinding ring 30.

A housing unit 40, made up of a plurality of circumferentially extending, side-by-side arcuate liners held in holders or otherwise removably fixed inside housing 24, face the balls 26 and are eroded by the passing pulverized coal as the pulverizer operates.

The balls 26, bottom grinding ring 28, top grinding ring 30, and housing unit 40, comprise the grinding wear parts of a type EL pulverizer 20, and require periodic replacement due to the abrasive nature of the raw coal.

Figure 1:
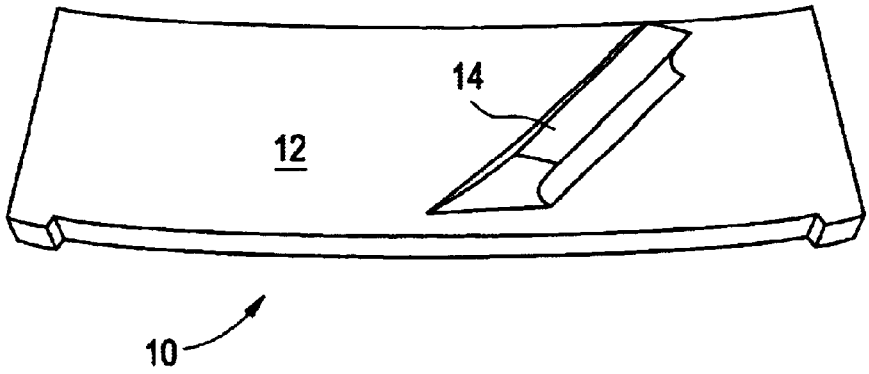
FIG. 1 PRIOR ART
FIG. 1 is a perspective view of a known housing liner in a condition when installed and before it has been eroded by use.
Figure 2:
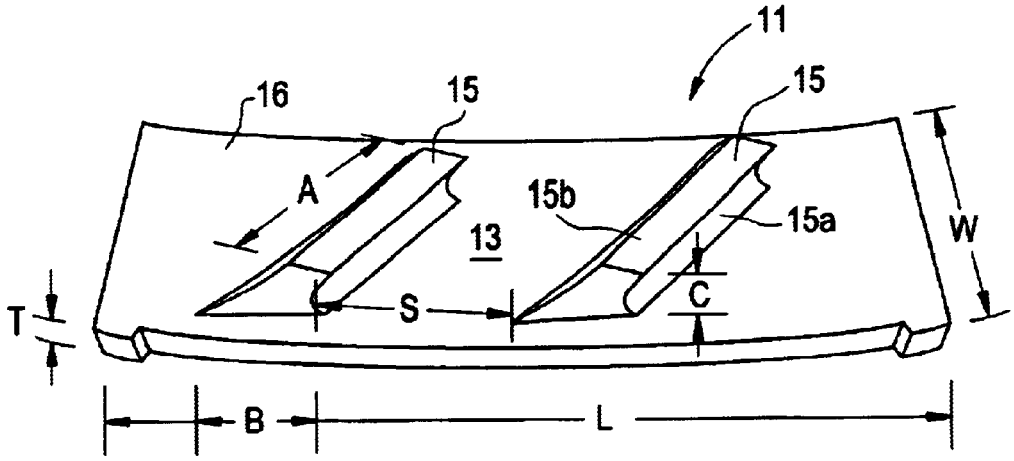
FIG. 2 is a view similar to FIG. 1 of a housing liner according to the present invention.

FIG. 2 illustrates one of the plural housing liners 11 that make up the housing unit 40.

Liner 11 comprises an arcuate liner body 16 having an inner curved surface 13 forming a segment of the circular housing unit 40, and two circumferentially spaced flutes 15 fixed to the inner surface 13.

Each flute 15 has one side 15*a*, in the flow direction of the pulverizer, which is concave in cross-section and extends at an acute angle to the vertical axis of the pulverizer. Each flute also has an opposite side 15*b* that is substantially flat and also extends at the same acute angle to the pulverizer axis. Side 15*b* is also inclined in cross-section toward the first side 15*a* from the base to the top of side 15*b*.

Figure 3:
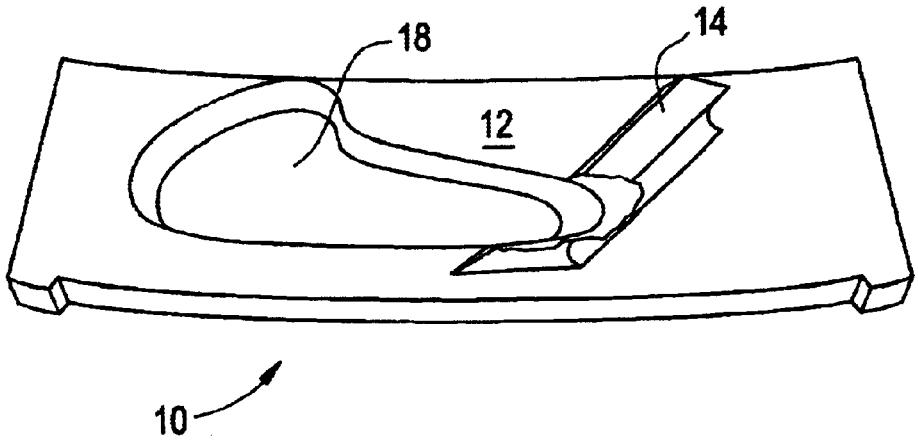
FIG. 3 PRIOR ART
FIG. 3 is a view similar to FIG. 1 of the known housing liner after it has been used and eroded and must be replaced.
Figure 4:
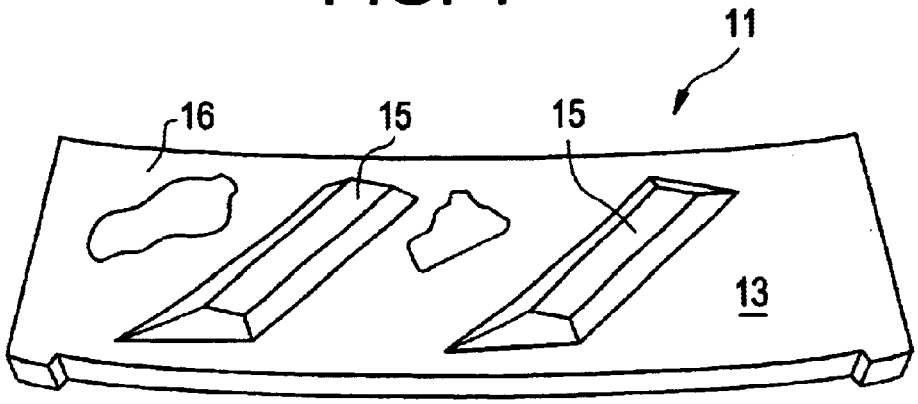
FIG. 4 is a view similar to FIG. 2 of the housing liner according to the present invention after it was subjected to the same degree of use as the known liner of FIG. 3.

This two-fluted housing liner 11 significantly reduces coal erosion by breaking up concentrated coal impact or coal recirculation zones in the housing liner area. FIG. 4 shows a wear pattern of the two fluted-housing liner that has not broken through the thickness of the liner body 16 and that has preserved the shape of the flutes 15 to a far greater extent than the single flute liner of FIG. 3 which was subjected to the same amount of use.

Figure 6:
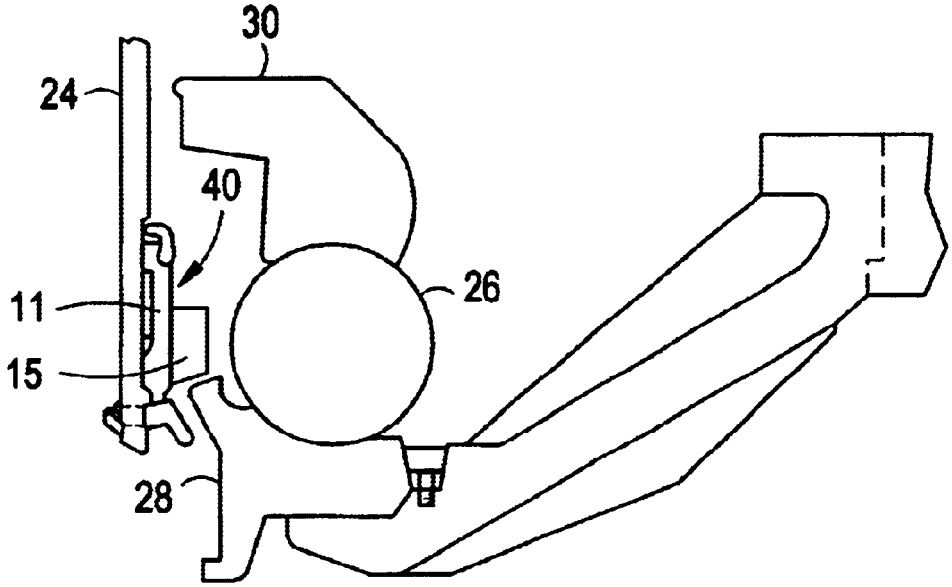
FIG. 6 is a detail cutaway view of a portion of the EL pulverizer shown in FIG. 5, and the grinding elements and housing unit associated therewith according to the present invention.

FIG. 6 is a detail cutaway view of a portion of the EL pulverizer 20, shown at FIG. 5, which illustrates one of the pulverizer balls 26 resting on a track established between the bottom grinding ring 28 and the top grinding ring 30. Also shown is the housing unit 40 which extends along a lower portion of the upright pulverizer housing 24, and depicts one the housing liners 11 and one of the flutes 15.

Individual liner segments are made from cast Ni-hard like material, for example. Each liner is approximately 24" long (dimension L in FIG. 2 that can be about 12" to 36") by 8-½" wide (dimension W that can be about 5" to 12") by 1-½" thick (dimension T that can be about 1" to 2"). Each liner body or segment is curved to match the ID curvature of the pulverizer housing unit 40. The flutes 15 are each formed with a raised area approximately 2-¼" above the liner surface (dimension C that can be about 1-½" to 3"). Each flute is angled to direct coal flow upward through the pulverizer, as well as break up circulating erosion/impact zones that can occur just ahead or behind adjacent flutes. The flute length A and base width B are selected to span the liner body as shown in FIG. 2. The spacing S between flutes 15 is about 5" to 10".

While a specific embodiment of the invention has been shown and described in detail to illustrate the application of the principles of the invention, it will be understood that the invention may be embodied otherwise without departing from such principles.

What is claimed is:

1. A pulverizer housing liner for a circular housing unit of a pulverizer, comprising: an arcuate liner body having an inner curved surface forming a segment of the circular housing unit; at least two circumferentially spaced flutes fixed to the inner surface; each flute having a substantially uniform cross-sectional area throughout its length and being inclined at an acute angle with respect to a vertical axis of the pulverizer; and wherein each flute has a first side with a concave cross-section and an opposite side that is inclined toward the first side.

2. A pulverizer comprising: an upright housing; a top grinding ring in the housing and having a grinding track to receive a plurality of pulverizer balls; a bottom grinding ring in the housing and having a grinding track to receive the plurality of pulverizer balls; and a housing unit extending around the tracks and made up of a plurality of circumferentially extending, side-by-side housing liners; each housing liner including an arcuate liner body covering a lower portion of the housing and having an inner curved surface forming a segment of the circular housing unit and at least two circumferentially spaced flutes fixed to the inner surface; each flute facing the pulverizer balls and having a substantially uniform cross-sectional area throughout its length, each flute being inclined at an acute angle with respect to a vertical axis of the pulverizer and having a first side with a concave cross-section and an opposite side inclined toward the first side.

3. The pulverizer according to claims 1 or 2, wherein the first side of each flute is disposed in the flow direction of the pulverizer.

4. The pulverizer according to claim 2, where in the lower portion of the housing covered by the arcuate liner body extends upwardly from the bottom grinding ring to the top grinding ring.

5. The pulverizer according to claims 1 or 2, wherein the distance between adjoining flutes as measured along the inner surface of the liner body is in the range of 5 to 10 inches.

6. The pulverizer according to claims 1 or 2, wherein the distance that each flute protrudes from the inner surface of the liner body is in the range of 1.5 to 3 inches.

* * * * *